US010643807B2

(12) United States Patent
Pizzato

(10) Patent No.: US 10,643,807 B2
(45) Date of Patent: May 5, 2020

(54) SAFETY SWITCH FOR ACCESS CONTROL

(71) Applicant: PIZZATO ELETTRICA S.R.L., Marostica (IT)

(72) Inventor: Marco Pizzato, Marostica (IT)

(73) Assignee: PIZZATO ELETTRICA S.R.L., Marostica (IT)

( * ) Notice: Subject to any disclaimer, the term of this patent is extended or adjusted under 35 U.S.C. 154(b) by 0 days.

(21) Appl. No.: 16/305,401

(22) PCT Filed: May 26, 2017

(86) PCT No.: PCT/IB2017/053131

§ 371 (c)(1),
(2) Date: Nov. 29, 2018

(87) PCT Pub. No.: WO2017/208124

PCT Pub. Date: Dec. 7, 2017

(65) Prior Publication Data

US 2019/0252138 A1 Aug. 15, 2019

(30) Foreign Application Priority Data

May 30, 2016 (IT) ..... 102016000055780

(51) Int. Cl.
*H01H 27/00* (2006.01)
*H01H 9/02* (2006.01)

(52) U.S. Cl.
CPC ..... *H01H 27/007* (2013.01); *H01H 9/0207* (2013.01); *H01H 27/002* (2013.01); *H01H 2223/024* (2013.01); *H01H 2223/028* (2013.01)

(58) Field of Classification Search
CPC ..... H01R 9/16; H01R 12/7011–707; H01R 13/73–748; H01H 27/007; H01H 27/002; H01H 9/0207; H01H 2223/024; H01H 2223/028
USPC ..... 439/527, 532, 542, 543, 574–576, 954
See application file for complete search history.

(56) References Cited

U.S. PATENT DOCUMENTS 6,827,607 B2 * 12/2004 Fujita ..... H01R 12/7047 439/573
7,351,116 B2 * 4/2008 Dold ..... H01R 9/2658 439/716
2014/0334139 A1 * 11/2014 Smith ..... F21S 9/02 362/191

* cited by examiner

*Primary Examiner* — Gary F Paumen
(74) *Attorney, Agent, or Firm* — Mark M. Friedman

(57) ABSTRACT

A safety switch for the control of access for machines and industrial plants comprises a casing adapted to be fastened to a fixed part of the access to be controlled and housing thereinside switching means) for controlling one or more control and/or service circuits of the machine or plant, driving means adapted to interact with the switching means upon the opening/closing of the access for opening/closing one or more circuits, anchoring means of the casing to the fixed part of the access, the anchoring means being integrated in the casing and adapted to allow the selective fixing to the fixed part of the access according to at least two mutually angled orientations, one or more auxiliary modules adapted to be selectively mounted to the longitudinal upper end of the casing, fixing means for fixing the one or more auxiliary modules to the casing.

10 Claims, 6 Drawing Sheets

SAFETY SWITCH FOR ACCESS CONTROL

TECHNICAL FIELD

The present invention is applicable in the field of electrical devices for industrial use and is particularly concerned with a safety switch for controlling access to industrial machines and plants adapted to be applied to mobile protections such as barriers, shelves, service panels or the like.

STATE OF THE ART

Known switches for controlling access to barriers and/or safety perimeters for industrial machines or pants generally comprise a switching device anchored to the fixed part of the access and an operating device anchored to the movable part.

Such switches are intended for blocking the plant upon the opening of the access for obvious safety reasons while activating one or more signaling or service circuits. Likewise, the switches can allow the machine or plant to restart immediately after the access has been closed unless there is a condition requiring a specific operator intervention.

The control of the switching means for opening and closing the power supply circuit of the machine or plant can be carried out either by means of a mechanical or electronic actuator.

In the first case, a key actuator associated with the movable device is usually provided and is adapted to fit into a slot of the switching device to interact with a drive mechanism of the switching means for opening/closing the supply circuit and any possible auxiliary circuits.

In some embodiments, the key actuator may be suitably shaped to recover any misalignment between the fixed and movable parts and allow the interaction between devices not even perfectly aligned.

EP2112674, in the name of the same applicant, discloses a switch with key actuator and centering system consisting of a centering pin associated with the movable actuator device, also provided with a key actuator, and designed to fit into a centering hole provided for in appropriate block mounted above the switching device.

Such a solution is limited to the fact that it cannot be applied indistinctly to accesses with different opening types unless it is provided by suitable adapters or supports to allow a different orientation of the switching device and the centering block.

The electronic actuator switches, as described, for example, in WO2015083143 in the name of the same applicant, provide that the two devices are provided with respective electronic circuits adapted to interact with each other by a recognition signal sent by the circuit associated with the actuator device so as to cause the opening or closing of the main power circuit depending on their reciprocal distance.

The switch described in the above-mentioned application also comprises centering means adapted to recover any possible misalignment between the devices.

In particular, the switching device comprises a casing housing internally the switching means designed to be connected to the power supply circuit of the machine or plant and a head rotatably mounted on the casing and housing the electronic circuit. The head also has a hole for inserting a centering pin associated with the actuator device.

The fixing of the casing to the fixed part of the barrier can take place according to a single orientation as the fixing holes are present only on the front face and on the rear face.

Therefore, in the event that the closing of the movable part does not occur in front of the housing, it is necessary to rotate the head by 90° so that both the interaction between the centering means and between the electronic circuits are allowed.

This configuration, although particularly effective and efficient, requires a relatively large number of components and leads to a greater axial development of the switching device.

Consequently, this solution, suitable for particularly complex installations, may be oversized and economically unsuitable for use with simpler machines or plants.

A similar solution is shown in DE 10 2006 006949, wherein a switch comprises a casing housing the switching means and associated with one or more actuator modules.

Also in this case, the casing has a single pair of front holes that allow it to be fastened according to a single orientation.

SCOPE OF THE INVENTION

The object of the present invention is to overcome the above mentioned drawbacks by providing a safety switch for controlling access of industrial machines and plants that exhibits high efficiency and relative cost efficiency.

A particular object is to provide a safety switch for controlling access for industrial machines and plants that is particularly simple and compact in order to reduce production and maintenance costs but at the same time be flexible in use, being able to be also associated with either with hinged opening or sliding openings, either of the right or left type.

A particular object is to provide such a switch that can be anchored to any type of opening without the use of external fixing means such as brackets or the like.

Yet another object is to provide such a switch in which the drive system is completely electronic in order to guarantee the highest security standards.

Such objects, as well as others that will become more apparent hereinafter, are achieved by a safety switch for controlling access for industrial machines and plants which, according to claim 1, comprises an casing adapted to be anchored to a fixed portion of the access to be controlled and housing thereinside switching means for controlling one or more control and/or service circuits of the machine or plant, driving means adapted to interact with said switching means at the opening/closing of the access for opening/closing one or more circuits, anchoring means of said casing to the fixed part of the access according to at least two different orientation rotated with each other, one or more auxiliary modules adapted to be selectively mounted at the upper longitudinal end of said casing, means for fixing said one or more auxiliary modules to said casing.

The anchoring means are integrated into said casing and are adapted to allow them to be selectively fixed to the fixed part of the access according to at least two reciprocally angled orientations.

In this way, it is possible to adapt the casing position to the specific opening mode of the access and apply it either to hinged openings or sliding openings, either right or left, without the need to provide auxiliary fastening elements such as brackets or the like and without being necessary to house the driving means and any centering means inside a head orientable relative to the casing.

In this way, in its minimal configuration, the switch will have a compact configuration and simple construction, being particularly cost effective.

With the term "access" it is meant to refer to both doors and panels, or to repair of barriers and perimeters of protection, and generally to any opening adapted to allow an operator to enter a protective barrier of a machine or industrial plant or only to insert an arm or hand to access a control panel or other part of the machine or plant.

Preferably, the anchoring means may comprise one or more pairs of passages that transversely cross said casing along respective reciprocally inclined and non-parallel development directions and which are adapted to selectively allow the insertion of a member for fixing the casing to the fixed portion of the access according to respective reciprocally angled orientations with an angle equal to the angle of inclination of said direction of development.

Preferably said transverse passages may extend along respective reciprocally orthogonal directions mutually intersecting each other.

This configuration will have the advantage of being particularly compact and not enhancing the encumbrance size and complexity, allowing to use common fixing systems normally used for similar switches.

In addition, the casing will have substantially symmetrical shape and may be anchored according one of two or more different orientations without the need for modifications or adaptations to the parts provided for its fixing.

Suitably, said driving means may comprise an actuator device adapted to be fixed to a movable part of the access and accommodating a transmitter element capable of interacting remotely with the switching means by sending a presence signal.

Further, the actuating means may comprise a receiver element housed in said casing and adapted to interact with said switching means for controlling the change of state upon receipt of said presence signal.

Advantageously, centering means may be provided to allow at least partial recovery of the alignment between the transmitter element and the receiving element, the means comprising a centering pin associated with said actuator device and a centering hole made in said casing and adapted to receive said centering pin at the closure of the access.

Conveniently, said casing will be a monolithic body provided with said transverse passages, said centering hole and a seat for housing said receiver element.

Thanks to this combination of features, the switch will be equipped with all the typical devices of the switches with the highest safety and reliability standards, while maintaining compactness, reduced encumbrance and greater constructive simplicity.

In particular, the switch thus made will be of the electronic drive type and therefore it will be adapted to implement thereinside all the controls typical of this type of electrical devices.

Not least, the switch may comprise one or more auxiliary modules for control and/or electrical connection mounted at the longitudinal ends of said housing and provided with control means and/or electrical or electronic connection means operably coupled to said switching means to control them and/or their connection to one or more circuits of the machine or plant, said one or more auxiliary modules being rotatably mounted on said casing to rotate about a longitudinal rotation axis.

In this way, the switch may be integrated with additional unlocking devices or safety devices such as emergency, signaling, control, which may be rotated with respect of the casing to be always in the most convenient and immediate direction for the intervention of the operator.

At the same time, the possibility of rotating the electrical or electronic connection module of the switching means to the supply and/or control circuits of the machine or plant will allow to orient the output of the connecting cables in such a manner to have the smaller possible route and avoid rotations or torsions that, in addition to representing an imperfection, can pose obvious security risks.

Advantageous embodiments of the invention are obtained according to the dependent claims.

BRIEF DISCLOSURE OF THE DRAWINGS

Further features and advantages of the invention will become more apparent in the light of the detailed description of some preferred but non-exclusive embodiments of a safety switch for controlling access for machine and industrial plants according to the invention, illustrated by way of not-limiting example with the aid of the attached drawing tables wherein.

BEST MODES OF CARRYING OUT THE INVENTION

With reference to the accompanying drawings, there are shown some preferred but not exclusive configurations of a safety switch for controlling access for industrial machines or plants designed to be applied, preferably but not exclusively, to a movable barrier or panel adapted to prevent unsafe access to a machine or industrial plant in action.

In a known manner, the switch is designed to be applied to the protection at an access thereof to substantially interrupt the operation of the machine or plant upon the opening of a door or closing panel of said access.

Figure 1:
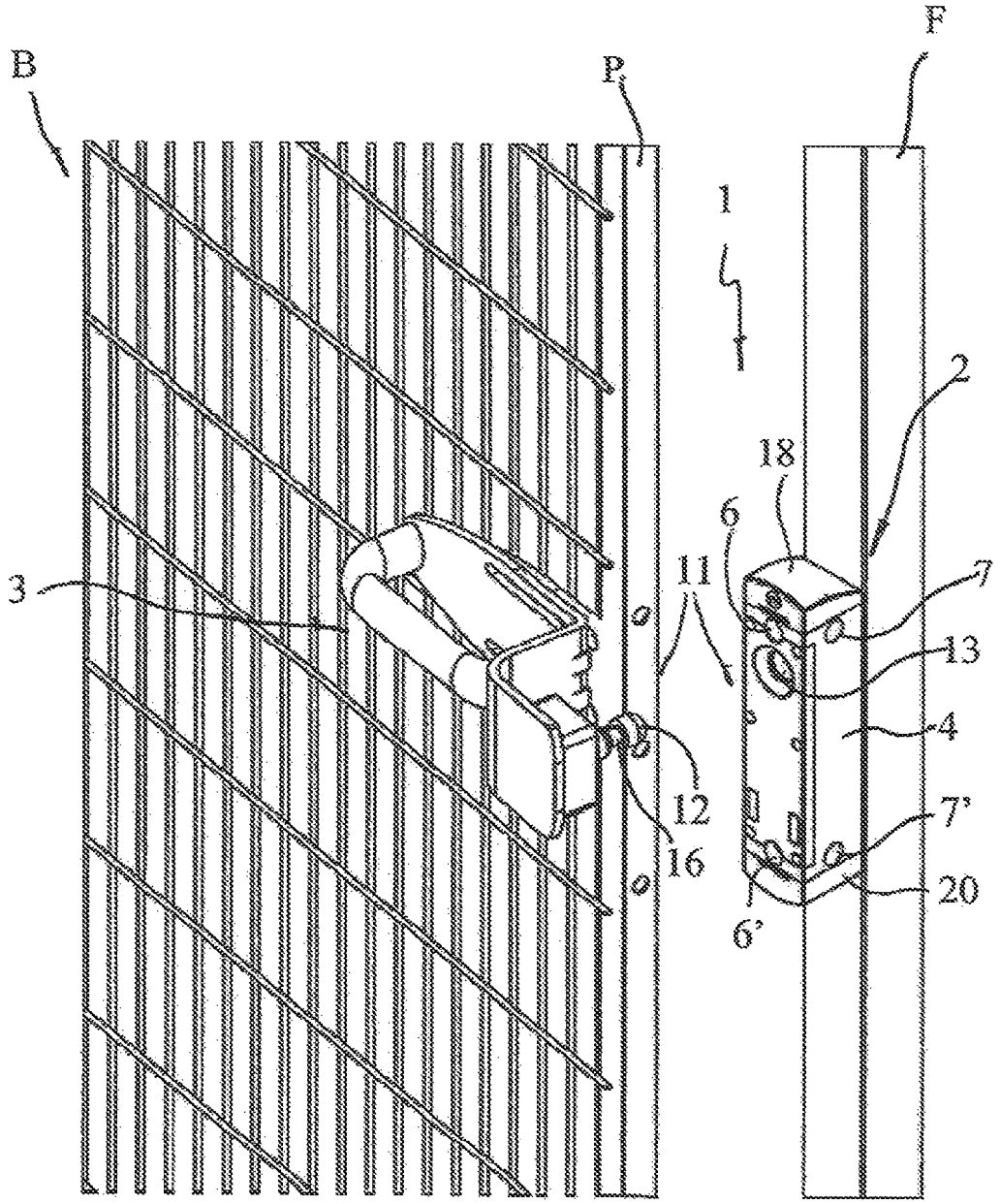
FIG. 1 is a perspective view of the switch in a first preferred embodiment and in a first way of assembling for fixing to a hinged access.

FIG. 1 shows a switch, generally indicated by 1, applied to an access of a protective barrier B provided with a left-wing swing door P.

The switch 1 comprises a switching device 2 adapted to be fixed to the fixed frame F of the protection B and connected in a known manner to one or more electrical and/or electronic circuits for powering and/or controlling the main circuit and/or service and emergency circuits, not shown.

The connection modes of the switching device 2 to such circuits are of a known type and are not part of the present invention, so they will not be described in more detail below.

On the movable part P of the barrier B is mounted an operating device 3 adapted to interact with the switching device 2 following the opening or closing of the access to determine the opening or closing of one or more circuits in a typical mode for such safety switches.

The switching device 2 comprises a casing 4 which can be anchored to the fixed part of the barrier B at the access to be controlled and housing inside the switching means for controlling one or more control circuits and/or service circuits of the machine or plant. Switching means, which are not visible from the figures as internal to the casing 4, may be selected from those commonly used in the industry and may also vary depending on the switch functionality without any particular limitations.

Inside the casing 4 there will also be provided driving means adapted to interact with the switching means upon the opening/closing of the access for opening/closing one or more circuits of the machine or plant following the interaction between the switching device 2 and operating device 3, also in this case according to known techniques.

The casing 4 is provided with anchoring means 5 to the fixed part F of the barrier B according to at least two different directions mutually rotated therebetween.

In particular, the anchoring means 5 are integrated into the casing 4 and are adapted to allow it to be selectively fixed to the fixed part F of the access without the need for additional supports such as brackets or the like.

Preferably, the anchoring means 5 will be configured to allow the anchorage of the casing 4 according to at least three different orientation planes rotated by each other about 90° around a common central axis defined by the main development longitudinal axis L of the casing 4.

Figure 2:
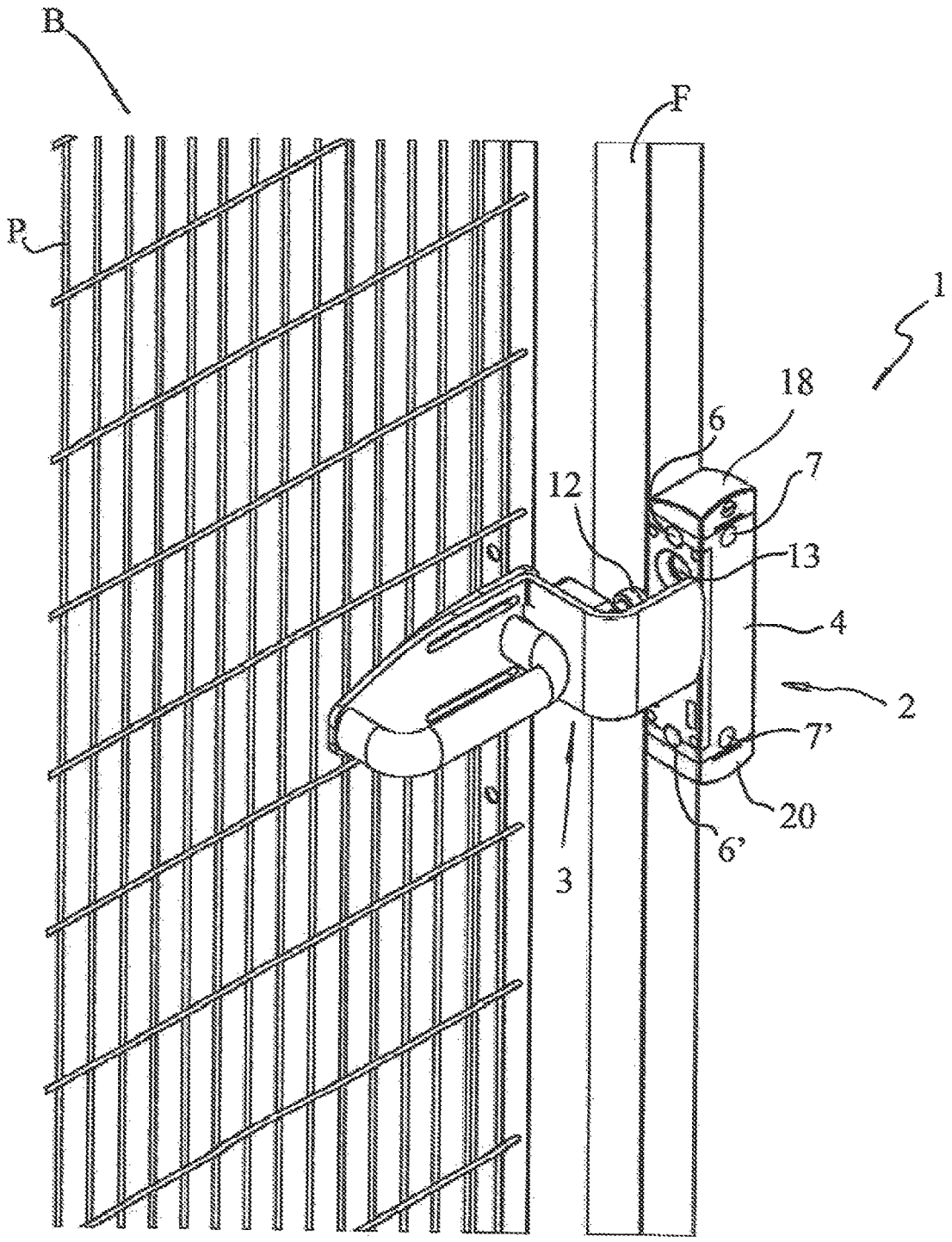
FIG. 2 is a perspective view of the switch of FIG. 1 in a second assembling way for fixing to a sliding access.

FIG. 2 shows the same prior switching device 2 wherein the casing 4 is rotated by 90° for fastening to frame F of a barrier B with sliding opening access.

From the same figures it is noted that according to a preferred configuration, the anchoring means 5 comprise two pairs of passages 6, 7; 6', 7' crossing transversely the housing 4 along respective directions of development X, Y; X', Y' are reciprocally orthogonal and are adapted to allow the selective insertion of a fixing member, such as a screw, pin or the like, not illustrated, suitable for locking the casing 4 to the fixed part F of the access.

In particular, there is provided a first pair of passages 6, 7 at the upper longitudinal end 8 of the casing 4 and a second pair of passages 6', 7' at the lower longitudinal end 9. More precisely, two passages 6, 6' are made frontally and two passages 7, 7' are made laterally.

Figure 3:
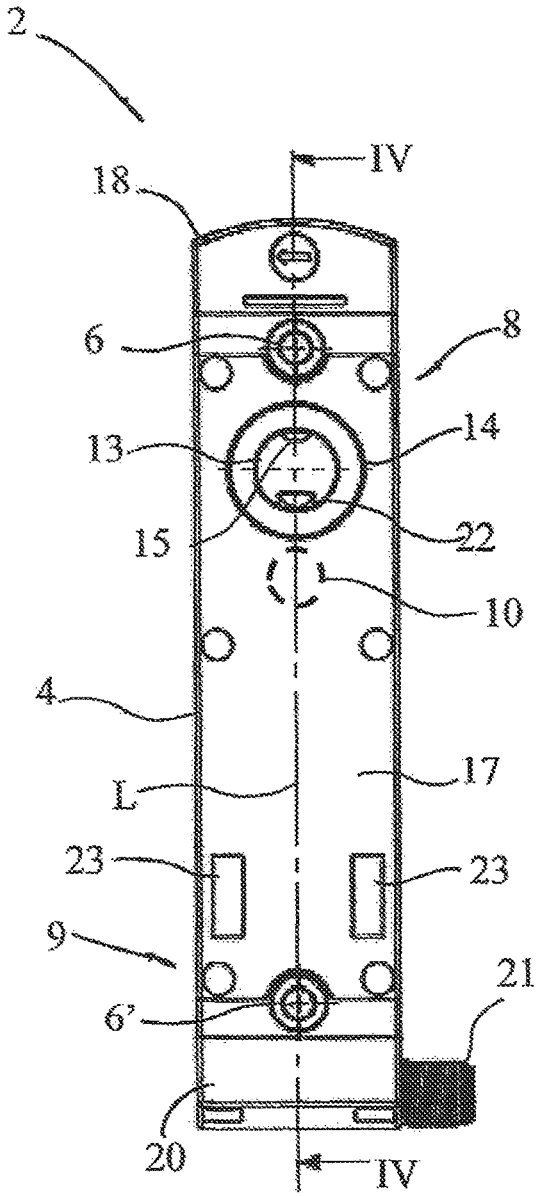
FIG. 3 is a front view of a detail of the switch of FIG. 1 in a third assembling way.
Figure 5:
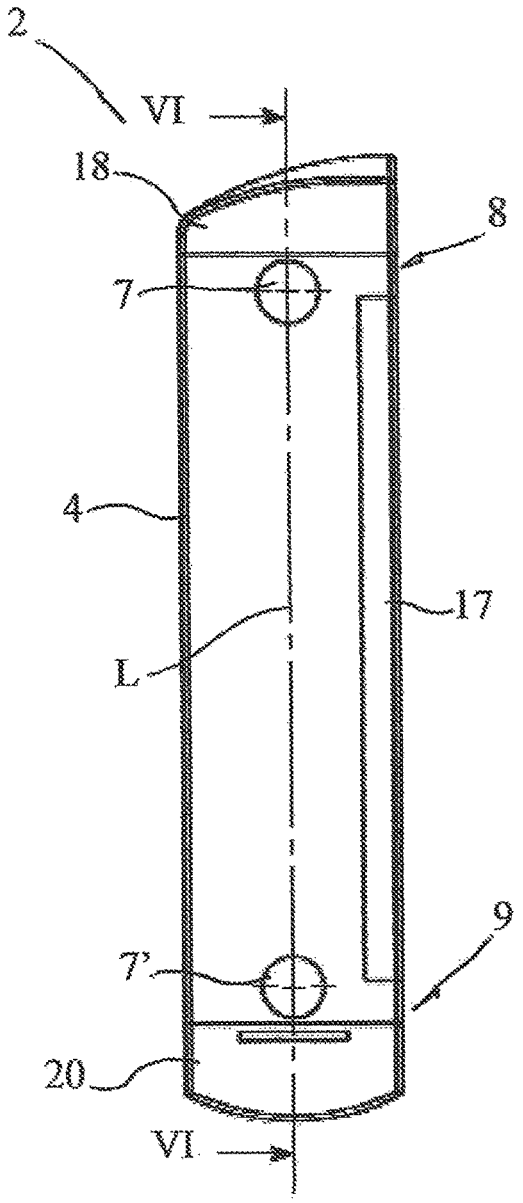
FIG. 5 is a side view of the detail of FIG. 3.

The anchorage of the casing 4 to the fixed part F of the barrier B may be obtained, in the case of a hinged opening, by inserting two fastening members in the two front passages 6, 6', which are more clearly visible in FIG. 3, or in case of sliding opening through the two lateral passages 7, 7', more clearly visible in FIG. 5.

Figure 4:
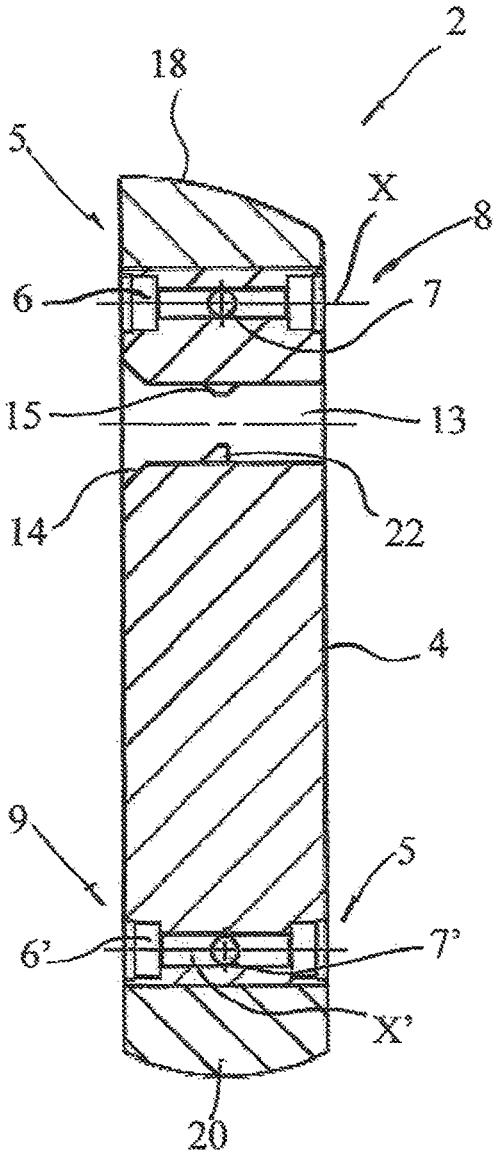
FIG. 4 is a sectioned view of the detail of FIG. 3 according to the IV-IV plane.
Figure 6:
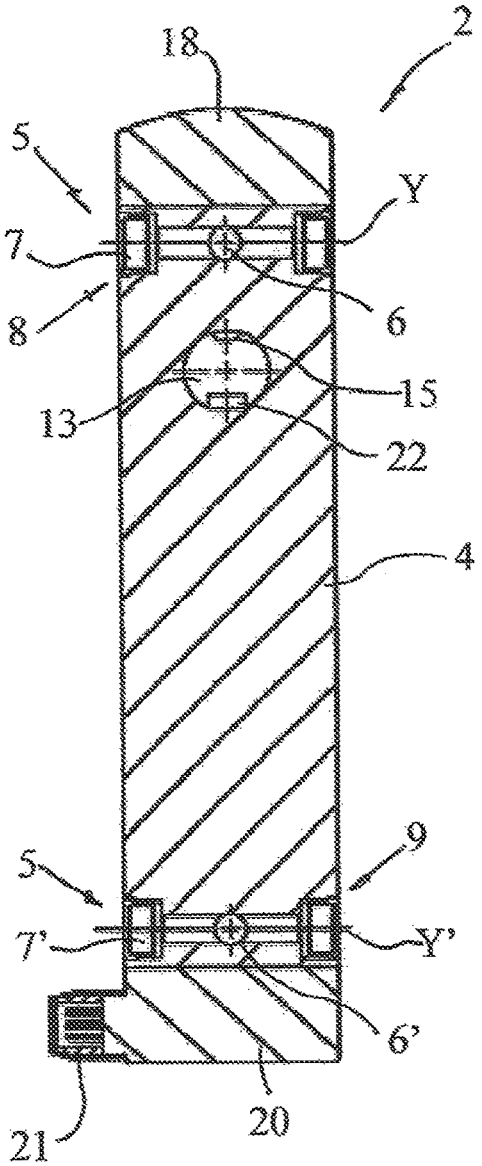
FIG. 6 is a sectioned view of the detail of FIG. 3 according to the VI-VI plane of FIG. 5.

As can be seen more clearly from the sections of FIGS. 4 and 6, the frontal passages 6, 6' and lateral passages 7, 7' of each pair mutually intersect so that the fixing height of the casing 4 does not depend on the orientation of the anchorage.

The switch 1 shown in the figures is of the electronic drive type, i.e. the action of the operating means on the switching means will be controlled by an electronic signal transmitted to the switching means according to known modes and described, for example, in the aforementioned WO2015083143.

To this end, the operating means will comprise a receiver element 10, for example an RFID antenna, dashed in the figure, housed inside the same casing 4 in a suitable seat opportunely arranged.

The antenna 10 is configured to receive a remote control signal, i.e. a presence signal, transmitted by a transmitter or transponder element housed in the movable actuator device 3, when the latter is at a predetermined minimum distance by the switching device 2 so that it is possible consider the access closed safely.

In particular, the transponder, not visible from the figures, will comprise a tag having an identification code that should be recognized by the antenna 10 to enable the starting of the machine or plant to start.

The code identification may be unique or generic, depending on whether you want to have a high or low encoding level for the switch.

The switch 1 is also provided with centering means 11 for allowing at least partial recovery of the alignment between the antenna 10 and the transponder in the case where the exact alignment between the parts has not been carried out during assembly, or the precise alignment is lost during use.

The centering means 11 comprise a centering pin 12 extending from the actuator device 3 and a centering hole 13 formed in front of the casing 4 and adapted to receive the centering pin 12 at the closing of the access.

The centering hole 13 has a flared inlet 14 to define an invitation for the pin 12 and provide a greater surface for recovering more accentuated misalignments.

Inside it a retaining mechanism 15 may also be provided for engaging a corresponding groove 16 of the pin 12 and preventing it from escaping as a result of vibrations or accidental strikes caused by the barrier B causing unwanted access openings.

Through the centering hole 13 the pin 12 may interact with a locking mechanism connected to the switching means and having a slider 22 having an end protruding inside the hole 13 to engage the groove 16 of the pin 12 and lock it by mechanical interference.

In essence, the casing 4 will be presented as a monolithic body provided with transverse passages 6, 6', 7, 7', with the centering hole 13 and with the seat for housing the antenna 10.

Also, the casing 4 will be provided with a removable lid 17 for access to its inside and thus to the switching means.

According to a not shown variant, the casing 4 may be realized without the lid 17 so that it cannot be accessed internally.

In both embodiments, with or without lid 17, the casing may also be provided with one or more signaling lights 23, preferably of a LED type, suitable for signaling the status of the different circuits connected to switch 1.

The casing 4 may also be made entirely of plastic material in order to further reduce the cost. In this case, the centering hole 13 may have a metallic ring at its flared input 14, to provide greater resistance to the impact with the pin 12.

The switching device 2 also comprises an auxiliary module 18 mounted at the upper end 8 of the casing 4.

The auxiliary module 18 may be a top closure module of the casing, such as a lid or module without special functions, or a control module with one or more service or emergency commands 19 adapted to interact with the switching means for the control of machine or plant circuits, such as selectors, mushroom emergency controls, cable controls, keylocks, or the like.

Likewise, at the lower end 9 of the casing 4, an auxiliary electrical connection module 20 may be provided, having means 21 for the electrical or electronic connection of the switching means for controlling the circuits of the machine or plant, such as multi-pole connectors, cable connectors or the like.

Figure 7:
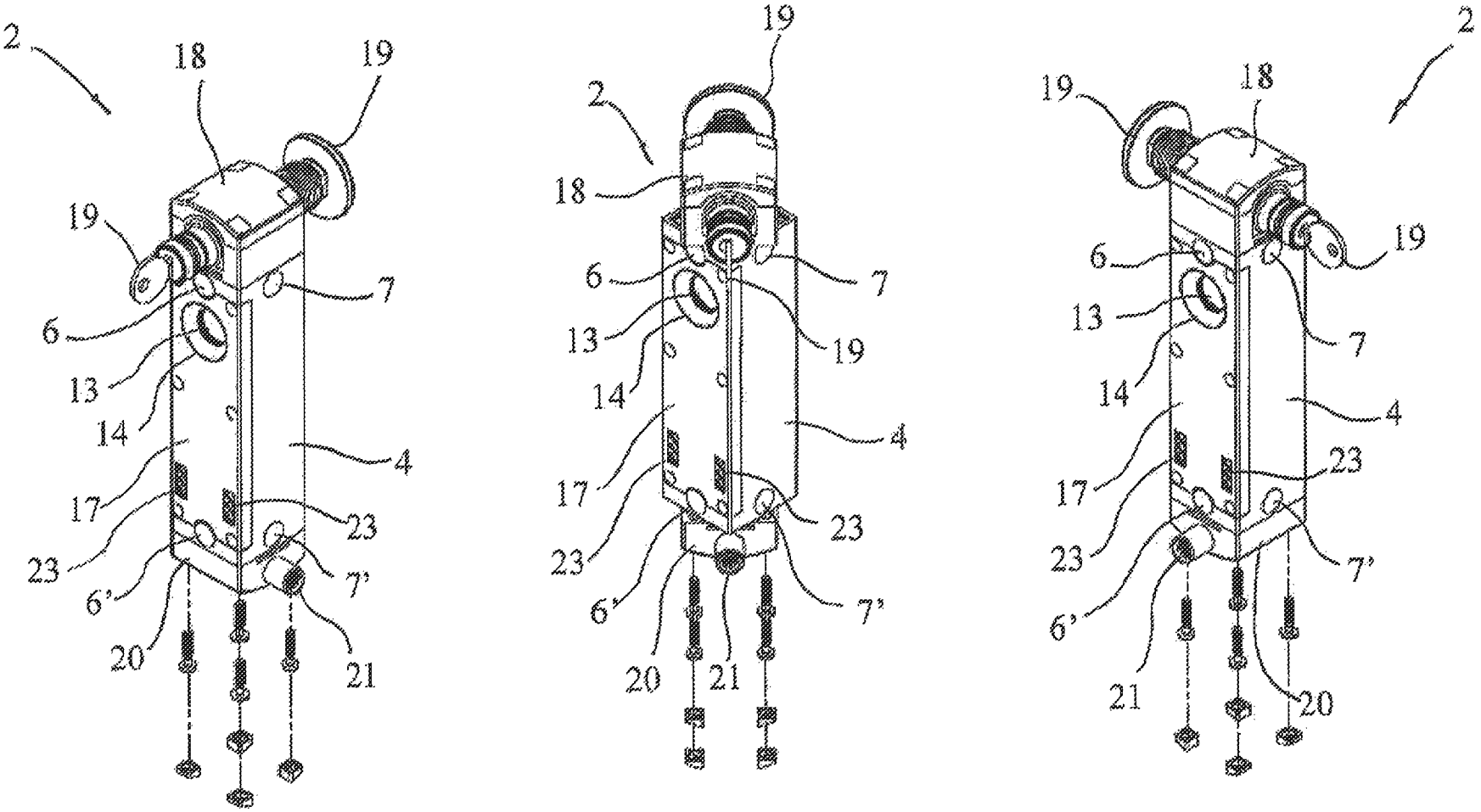
FIG. 7 is a perspective view of the detail of FIG. 3 in a rotation sequence of the end modules.

As shown in FIG. 7, such modules 18, 20 are rotatably mounted relative to the casing 4 to rotate independently with each other about the longitudinal axis L thereof and be oriented in the most appropriate direction depending on the position in which the casing 4 is oriented.

The fastening of the modules 18, 20 can be achieved by fastening means, not visible from the figures, selected according to the type of module 18, 20.

For example, the fastening means may include passing-trough screws adapted to be longitudinally inserted for locking the module 18, 20 to the side wall of the casing 4 or may be of a snap-type to lock the module 18, 20 directly to the upper or lower face of the casing 4.

Figure 8:
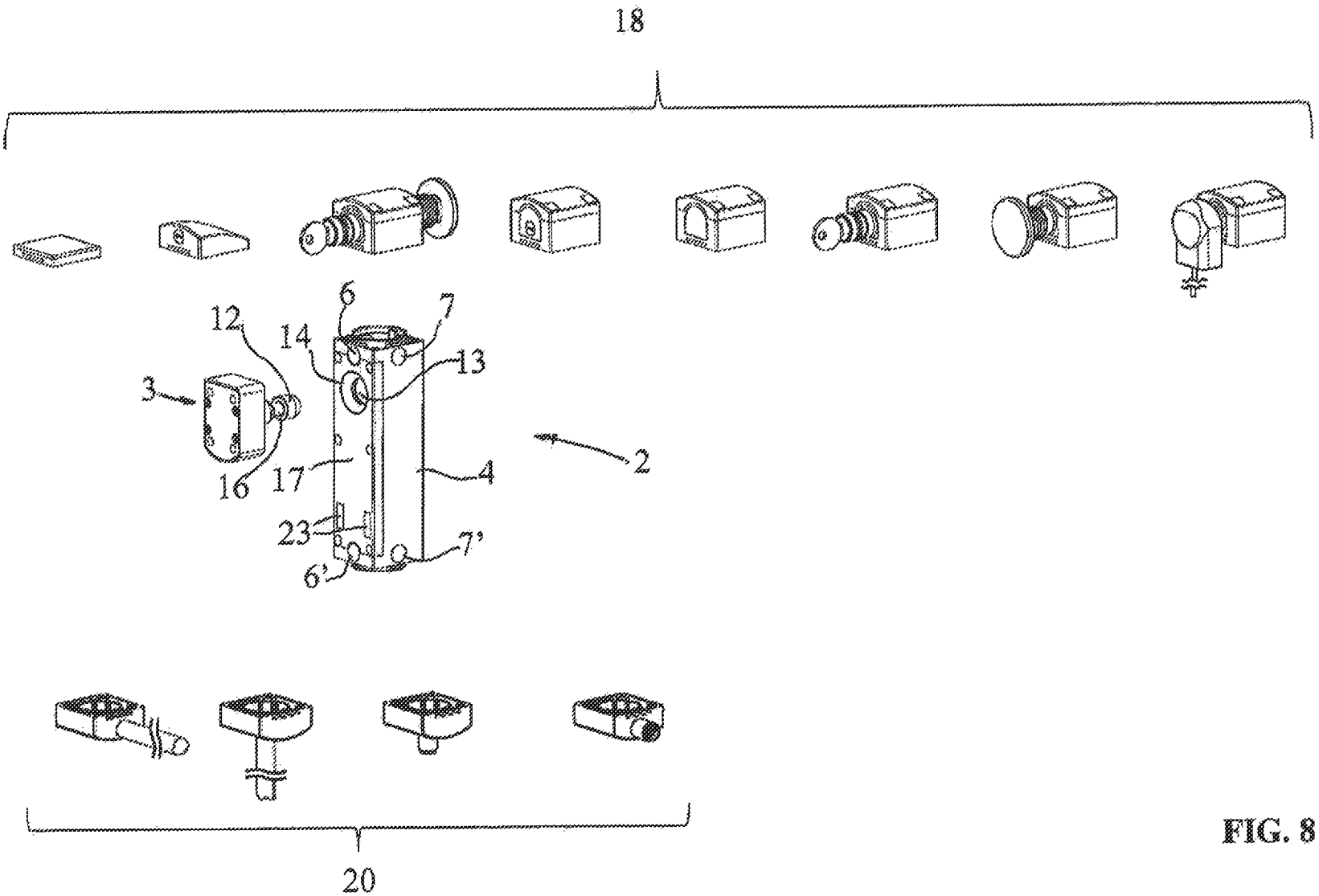
FIG. 8 is a perspective view of a switch according different possible embodiments.

FIG. 8 shows some possible embodiments of the control modules 18 and of the electrical connection modules 20 which can be coupled to the same casing 4.

It is also specified that the switch 1 may be provided both with the control module 18 and the connecting module 20, or by only one of them or with no modules. Moreover, from the same figure it is noted that in place of the control modules 18 a simple lid or a module with no specific function may be mounted.

Form above description it is apparent that the switch according to the invention achieves the indented objects and in particular it is particularly compact, simple and economical but at the same time it guarantees high standards of safety and reliability.

The switch according to the invention is susceptible of numerous modifications and variations, all of which fall within the inventive concept as set forth in the appended claims. All details may be replaced by other technically equivalent elements, and the materials may be different according to the needs without departing from the scope of the present invention.

Although the switch has been described with particular reference to the attached figures, the reference numbers used in the description and claims are used to improve the intelligence of the invention and do not constitute any limitation to the claimed scope.

The invention claimed is:

1. A safety switch for the control of access to machines and industrial plants, comprising:

a casing (4) adapted to be fastened to a fixed part (F) of the access to be controlled and having a main development longitudinal axis (L);

switching means housed into said casing (4) for controlling one or more control and/or service circuits of the machine or plant;

driving means adapted to interact with said switching means upon the opening/closing of the access for opening/closing one or more circuits;

anchoring means (5) of said casing (4) to the fixed part (F) of the access;

one or more auxiliary modules (18) adapted to be selectively mounted to the longitudinal upper end (8) of said casing (4);

fixing means for fixing said one or more auxiliary modules (18) to said casing (4);

wherein said anchoring means (5) are integrated in said casing (4) and adapted to allow the selective fixing to the fixed part (F) of the access according to at least two mutually angled orientations and according orientation planes rotated by each other about 90° around a common central axis defined by said main development longitudinal axis (L) of said casing (4);

wherein said anchoring means (5) comprise at least one pair of passages (6, 7) crossing transversally said casing (4) along respective extension directions (X, Y) mutually inclined and not parallel to each other and adapted to selectively allow the insertion of a fixing member of the casing (4) to the fixed part (F) of the access according to respective mutually angled orientations with an angle equal to the angle of inclination of said extension directions (X, Y);

wherein said at least one pair of passages (6, 7) comprises a passage (6) made frontally in said casing (4) and a passage (7) made laterally in said casing (4);

wherein said drive means comprise an operating device (3) adapted to be fixed to a movable part (P) of the access and housing a transmitter adapted to remotely interact with said switching means by sending a presence signal and a receiver (10) housed in said casing (4) and adapted to interact with said transmitter for receiving said presence signal and operating the change of state of said switching means;

wherein centering means (11) being provided for at least partially recovering the alignment between said transmitter and said receiver (10), said centering means (11) comprising a centering pin (12) associated with said operating device (3) and a centering hole (13) formed in the front of said casing (4) and adapted to receive said centering pin (12) upon the closure of the access;

wherein said casing (4) is a monolithic body provided with said transverse passages (6, 7), with said centering hole (13) and with a seat for housing said receiver (10).

2. Switch as claimed in claim 1, characterized in that said transverse passages (6, 7) extend along respective directions (X, Y) mutually orthogonal to each other.

3. Switch as claimed in claim 1, characterized in that said transverse passages (6, 7) are mutually intersecting.

4. Switch as claimed in claim 1, characterized in that said anchoring means (5) comprise at least two pairs of said transverse passages (6, 7, 6', 7') arranged at respective longitudinal ends (8, 9) of said casing (4).

5. Switch as claimed in claim 1, characterized in that said switching means are operatively coupled to a locking mechanism having a slider (22) adapted to project in said centering hole (13) to lock said centering pin (12) by mechanical interference.

6. Switch as claimed in claim 1, characterized in that said casing (4) has one or more signal LED lights (23) adapted to indicate the opening/closure condition of circuits connected to said switching means.

7. Switch as claimed in claim 1, characterized in that said one or more auxiliary control modules (18) are selected into the group comprising closing modules and the control modules provided with control means (19) adapted to be operatively coupled to said switching means for controlling them.

8. Switch as claimed in claim 7, characterized in that said one or more auxiliary control modules (18) are rotatably mountable on said casing (4) to rotate around a longitudinal axis of rotation (L).

9. Switch as claimed in claim 1, characterized by comprising one or more electrical connection modules (20) adapted to be selectively mounted at the lower longitudinal end (9) of said casing (4) and provided with electrical or electronic connection means (21) operatively coupled to said switching means for their connection to one or more circuits of the machine or plant.

10. Switch as claimed in claim 9, characterized in that said one or more electrical connection modules (20) are rotatably mounted on said casing (4) to rotate about a longitudinal axis of rotation (L).

* * * * *